United States Patent [19]

Hildebrand

[11] 4,085,877

[45] Apr. 25, 1978

[54] PAINT TRAY CARRIER

[76] Inventor: George M. Hildebrand, P.O. Box 135, Junction City, Calif. 90648

[21] Appl. No.: 760,682

[22] Filed: Jan. 19, 1977

[51] Int. Cl.[2] ..... A47G 23/06

[52] U.S. Cl. ..... 224/48 R; 16/111 R; 16/115

[58] Field of Search ..... 224/45 R, 45 Q, 45 P, 224/49, 48 R, 48 E, 48 W; 294/30, 34, 32, 27 R, 103 R; 16/111 R, 115, 114 R, 110; 229/52 A, 52 AM, 52 AW; 220/8, 94 R; D9/242, 243; D64/18; D87/1 R

[56] References Cited

U.S. PATENT DOCUMENTS

| | | | |
|---|---|---|---|
| 1,606,441 | 11/1926 | Nelms | 224/48 E |
| 2,915,082 | 12/1959 | Shaw | 224/45 R X |
| 3,433,383 | 3/1969 | Phibbs | 220/8 X |
| 3,575,455 | 4/1971 | Bloch | 224/45 R |

FOREIGN PATENT DOCUMENTS

| | | | |
|---|---|---|---|
| 48,057 | 12/1920 | Sweden | 224/49 |
| 316,450 | 10/1969 | Sweden | 220/8 |

*Primary Examiner*—Drayton E. Hoffman
*Assistant Examiner*—Donald W. Underwood
*Attorney, Agent, or Firm*—Keith D. Beecher

[57] ABSTRACT

A carrier bracket is provided for a paint tray of the type used in conjunction with paint application rollers. The bracket is adjustable to fit various sizes of paint trays. The bracket enables the tray conveniently to be carried from place-to-place during the painting operation, and up and down ladders, for example, by one hand and without any tendency to spill the paint in the tray.

3 Claims, 3 Drawing Figures

PAINT TRAY CARRIER

BACKGROUND OF THE INVENTION

Interior and exterior house painting has become greatly facilitated with the advent of paint application rollers. To use the roller, paint is poured into a special tray from the can, and the roller is rolled in the paint in the tray and then used to apply a coating to the surface to be painted.

In the past, it has proven to be awkward to move the paint tray from place to place, since the operation entailed two hands, and the paint in the tray has a tendency to spill out when the tray was being moved.

The carrier bracket of the present invention is advantageous since it provides a simple means for carrying the paint tray with one hand from location-to-location, and up and down a ladder. The carrier of the invention aids the paint application roller operation, since it makes it possible for the painter to carry the tray with him when he moves about, easily and without any tendency for the paint in the tray to spill.

DETAILED DESCRIPTION OF THE ILLUSTRATED EMBODIMENT

Figure 2:
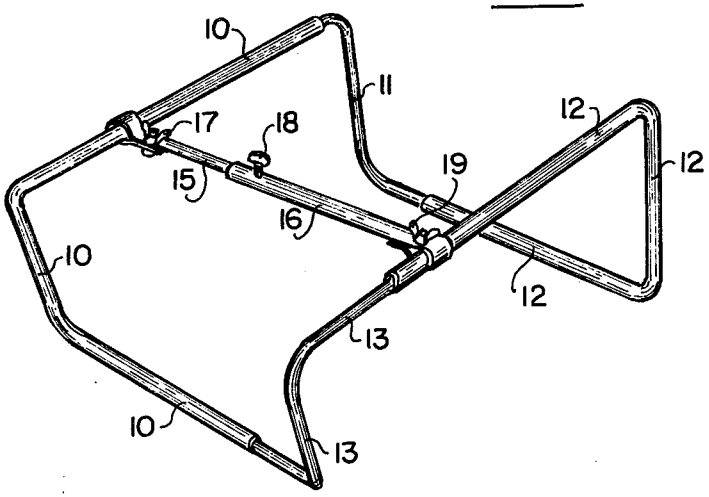
FIG. 2 is a perspective view of the carrier, representing one embodiment of the invention, with the paint tray removed.

The carrier bracket of the invention, in the illustrated embodiment, is formed of four tubular members 10, 11, 12 and 13 which are telescoped into each other. The tubular members for a carrier bracket which has two transverse lower sections that extend under the paint tray 14 in spaced and parallel relationship at each end of the tray. The telescoping relationship of the tubular members 10, 11, 12 and 13 permits the carrier bracket to be adjusted to fit trays 14 of different widths and lengths.

As illustrated, the tubular members 10 and 12 are configured also to defined a pair of upper sections that extend longitudinally above the tray 14 at each side thereof. A handle 16 extends across the upper section of the tubular members 10 and 12. As shown, the handle is formed of two telescoping tubular members 15 and 16 which enable the handle to be adjusted to accommodate different widths of the bracket means. The ends of the tubular members 15 and 16 are lodged around the upper sections of tubular members 10 and 12, and thus are secured to the tubular members 10 and 12 by appropriate screws and wing nuts 17 and 19. The handle tubular members 15 and 16 are held together in any present telescoped relationship by a set screw 18.

Figure 3:
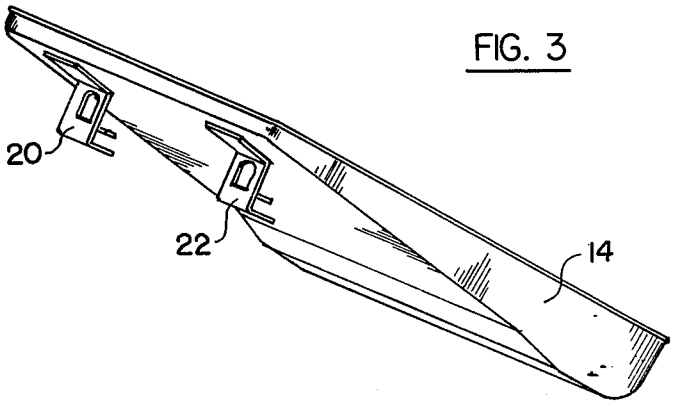
FIG. 3 is a perspective view of the underside of the paint tray showing a pair of clips which are used to attach the tray to the bracket of FIG. 2.
Figure 1:
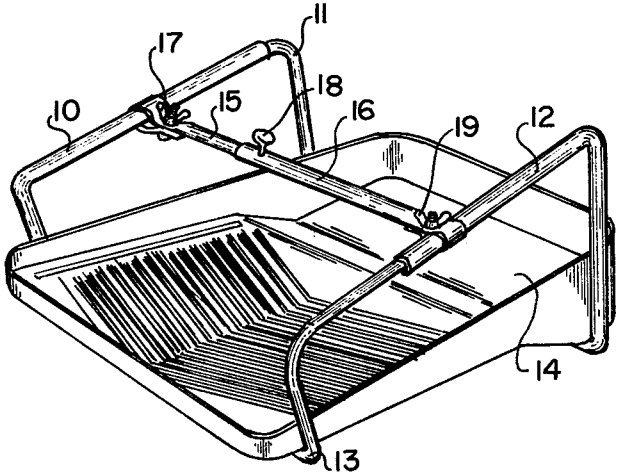
FIG. 1 is a perspective representation of a paint tray and carrier incorporating the concepts of the invention.

The paint tray 14 is securely held within the carrier bracket by means of a pair of clips 20,22. The clips are attached to the forward end of the tray 14, and depend downwardly from the underside of the tray, as best shown in FIG. 3. The clips engage the forward lower transverse section of the tubular members 10 and 12 securely to hold the tray within the carrier bracket.

The invention provides, therefore, a carrier bracket for a paint tray which is adjustable to fit various sizes of trays, and which provides a simple means whereby the tray may be carried by one hand from location-to-location during the roller operation.

It will be appreciated that although a particular embodiment of the invention has been shown and described, modifications may be made. It is intended in the claims to cover the modifications which come within the spirit and scope of the invention.

What is claimed is:

1. A paint tray carrier and paint tray combination comprising: a paint tray; an endless tubular bracket configured to surround the paint tray and comprising a pair of spaced and parallel lower transverse tubular sections adapted to extend under the tray and a pair of spaced and parallel upper longitudinal tubular sections adapted to extend above the tray at each side thereof; and a handle member extending across the tray from one of the upper sections to the other, and which includes at least one clip member attached to and projecting downwardly from the undersurface of the tray to engage one of the lower transverse tubular sections of the bracket.

2. The paint tray carrier and paint tray combination defined in claim 1, in which said tubular bracket is formed of four tubular members telescoped into one another to enable the bracket to fit a plurality of paint trays of different widths and lengths.

3. The paint tray carrier and paint tray combination defined in claim 2, in which said handle member is formed of two tubular members telescoped into one another.

* * * * *